United States Patent [19]

Nomura et al.

[11] Patent Number: 5,042,736

[45] Date of Patent: Aug. 27, 1991

[54] APPARATUS FOR PRODUCTION OF THIN STRIP CORE, METHOD FOR THE PRODUCTION OF A THIN STRIP CORE AND THIN STRIP CORE

[75] Inventors: Katunori Nomura; Hiroaki Anse; Yoshiyuki Yamauchi, all of Yokohama, Japan

[73] Assignee: Kabushiki Kaisha Toshiba, Kawasaki, Japan

[21] Appl. No.: 412,824

[22] Filed: Sep. 26, 1989

[51] Int. Cl.[5] ..... B65H 18/00

[52] U.S. Cl. ..... 242/56 R; 242/57; 29/605

[58] Field of Search ..... 242/7.01, 7.02, 7.03, 242/7.07, 7.12, 7.21, 7.23, 56 R, 56.1, 68.5, 57; 29/605

[56] References Cited

U.S. PATENT DOCUMENTS

| | | | |
|---|---|---|---|
| 2,191,393 | 2/1940 | Humphreys | 242/7.03 X |
| 3,453,726 | 7/1969 | Roen | 242/56 R X |
| 3,466,744 | 9/1969 | Hughes | 242/56 R X |
| 3,474,983 | 10/1969 | Whiteman | 242/7.03 |
| 4,896,839 | 1/1990 | Curtis et al. | 242/7.01 |

FOREIGN PATENT DOCUMENTS

| | | | |
|---|---|---|---|
| 246613 | 12/1985 | Japan | 242/7.01 |

*Primary Examiner*—Joseph J. Hail, III
*Attorney, Agent, or Firm*—Foley & Lardner

[57] ABSTRACT

The apparatus for the production of a thin strip core comprises a spool for winding a ribbon-like thin strip, a clamping device for clamping and moving the ribbon-like thin strip, a winding core driving device for causing the ribbon-like thin strip clamped by the clamping device to be wound in a prescribed length around a winding core, a cutting device for cutting the ribbon-like thin strip after the ribbon-like thin strip has been wound in the prescribed length around the winding core, a welding device for welding the trailing end of the wound thin strip cut off, a releasing device for releasing the connected wound thin strip, and a measuring device for taking the weight of wound thin strip released. This invention can produce the thin strip core quickly because all of the works involved in the production of the thin strip core are automatically carried out without requiring any manual operation. Further, it imparts a fixed weight to all of the wound thin strip of product owing to the procedure which comprises weighing each wound thin strip immediately after the wound thin strip is cut off and setting the number of plies of winding for the next wound thin strip in due consideration of the cycle of thickness of thin strip so that the next wound thin strip will assume the prescribed weight.

12 Claims, 15 Drawing Sheets

$\Delta\theta$ IS A CONSTANT SET IN EACH FORMATION SIZE

APPARATUS FOR PRODUCTION OF THIN STRIP CORE, METHOD FOR THE PRODUCTION OF A THIN STRIP CORE AND THIN STRIP CORE

BACKGROUND OF THE INVENTION

This invention relates to an apparatus for the production of a thin strip.

In recent years, a thin strip of amorphous metal has been attracting a general interest as a material for the formation of magnetic cores for transformers or magnetic cores for magnetic amplifiers. This thin strip is obtained by melting the corresponding amorphous alloy, cooling the molten alloy at a very high speed, forming it in the form of a thin sheet, and winding the thin sheet into a roll.

Specifically, this production comprises manually setting a winding jig in place on a winding device provided with a rotary shaft, setting the number of plies of winding calculated to account for a prescribed weight of the finished roll, and winding the thin strip of amorphous metal around the rotary shaft until the preset number of plies is reached.

Then, the produced roll is fixed in place with jigs and adhesive tapes lest it should deform and the trailing end of the thin strip is cut. Thereafter, the finished roll is removed from the winding device in conjunction with the winding jig.

When the production of the thin strip is effected by the method described above, however, the works of setting the winding jig on the winding device and removing the winding jig, for example, must be manually carried out.

The inventors have found that when the thin strip of amorphous metal is produced by the suddenly cooling method, the produced thin strip suffers from dispersion of thickness. That is, as shown in FIG. 5, the thickness of the produced thin strip has the approximately relation of trigonometric i.e. sinusoidal functions with the length.

The conventional method of production makes a rule of winding the thin strip of metal in a prescribed number of plies and separating the produced roll from the following strip of thin strip by inserting a cut in the trailing end of the roll. The dispersion of thickness mentioned above, therefore, gives rise to a dispersion of weight between one roll of product and another. Still, the inventors have found that the weight of the next roll is 0.95 to 1.05 times of that of the previous one.

SUMMARY OF THE INVENTION

The object of this invention is to provide an apparatus for the production of a thin strip, which apparatus is capable of automatically and quickly producing the thin strip and, at the same time, and imparting a fixed weight to the cut sections of thin strip.

To accomplish the object described above, the apparatus for the production of a thin strip core of this invention comprises a spool for winding a ribbon-like thin strip, clamping means for clamping and moving said ribbon-like thin strip, winding core driving means for causing said ribbon-like thin strip clamped by said clamping means to be wound in a prescribed length around a winding core, cutting means for cutting said ribbon-like thin strip after said ribbon-like thin strip has been wound in said prescribed length around said winding core, connecting means for connecting the trailing end of said wound thin strip cut off by the cutting means, releasing means for releasing the connected wound thin strip, and means for taking the weight of wound thin strip released by the releasing means.

This invention can produce the thin strip core quickly because all of the works involved in the production of the thin strip core are automatically carried out without requiring any manual operation. Further, it imparts a fixed weight to all of the wound thin strip of product owing to the procedure which comprises weighing each wound thin strip immediately after the wound thin strip is cut off and setting the number of plies of winding for the next wound thin strip in due consideration of the cycle of thickness of thin strip so that the next wound thin strip will assume the prescribed weight.

The present invention permits provision of an apparatus for the production of a thin strip core, which apparatus is capable of automatically and quickly producing the thin strip core and ensuring impartation of a fixed weight to the cut sections of thin strip core.

DESCRIPTION OF THE PREFERRED EMBODIMENTS

Now, the present invention will be described in detail herein below with reference to the accompanying drawings.

Figure 1:
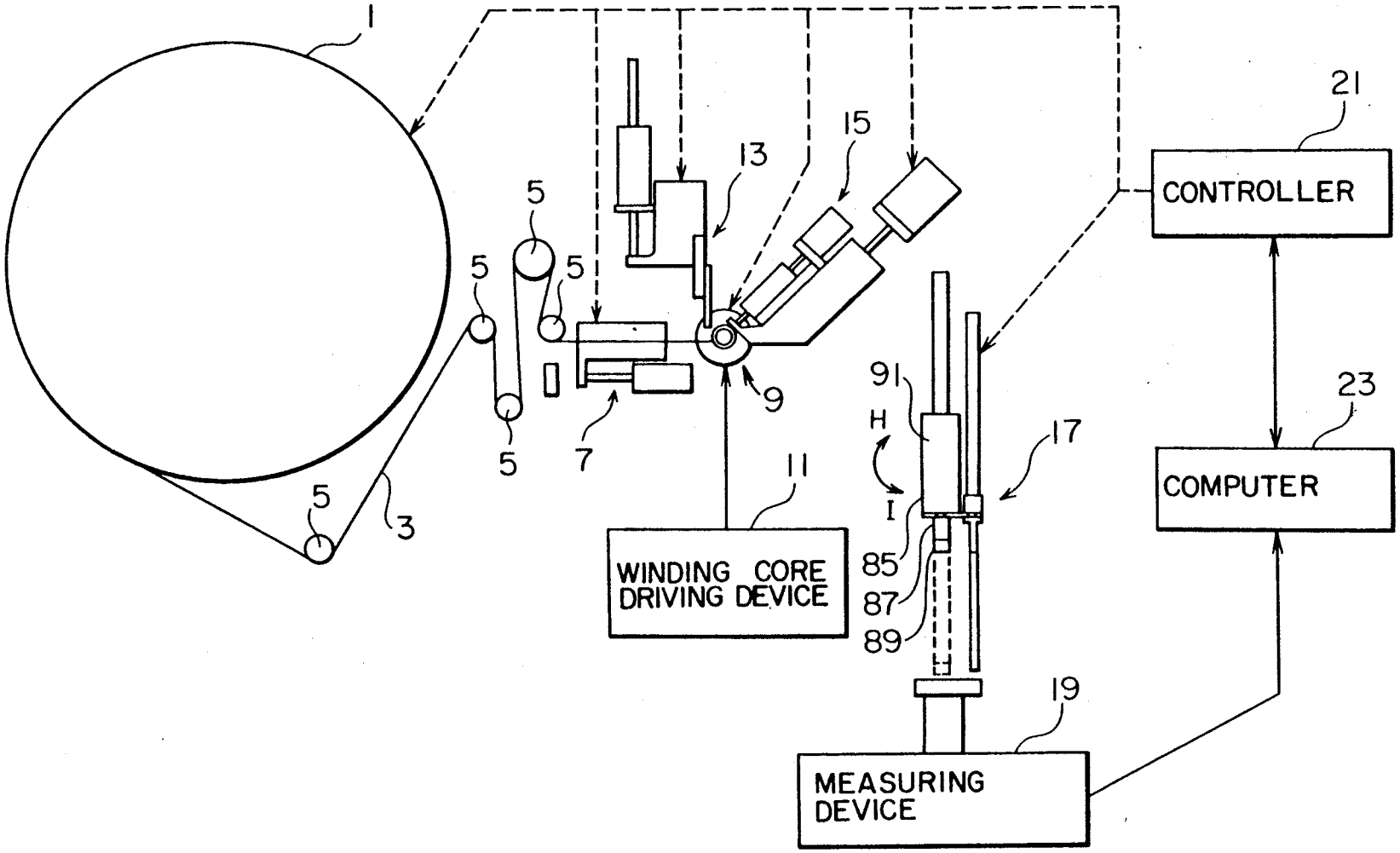
FIG. 1 is a diagram illustrating schematically the construction of an apparatus for the production of a thin strip.

FIG. 1 is a diagram illustrating schematically the construction of an apparatus for the production of the thin strip.

This apparatus for the production of a thin strip comprises a material spool 1, a ribbon-like thin strip 3, guide rollers 5, a clamping device 7, a winding core 9, a winding core driving device 11, a cutting device 13, a connecting means such as a welding device 15, a releasing device 17, a measuring device 19, a controller 21, and a computer 23.

The material spool 1 has the ribbon-like thin strip 3 such as, for example, a thin strip of amorphous metal, wound up concentrically in a roll.

The guide rollers 5 cooperate to forward this ribbon-like thin strip 3 to the clamping device 7.

The clamping device 7 serves the purpose of clamping the ribbon-like thin strip 3 and inserting it into a thin hole 45 in the winding core 9.

Figure 2:
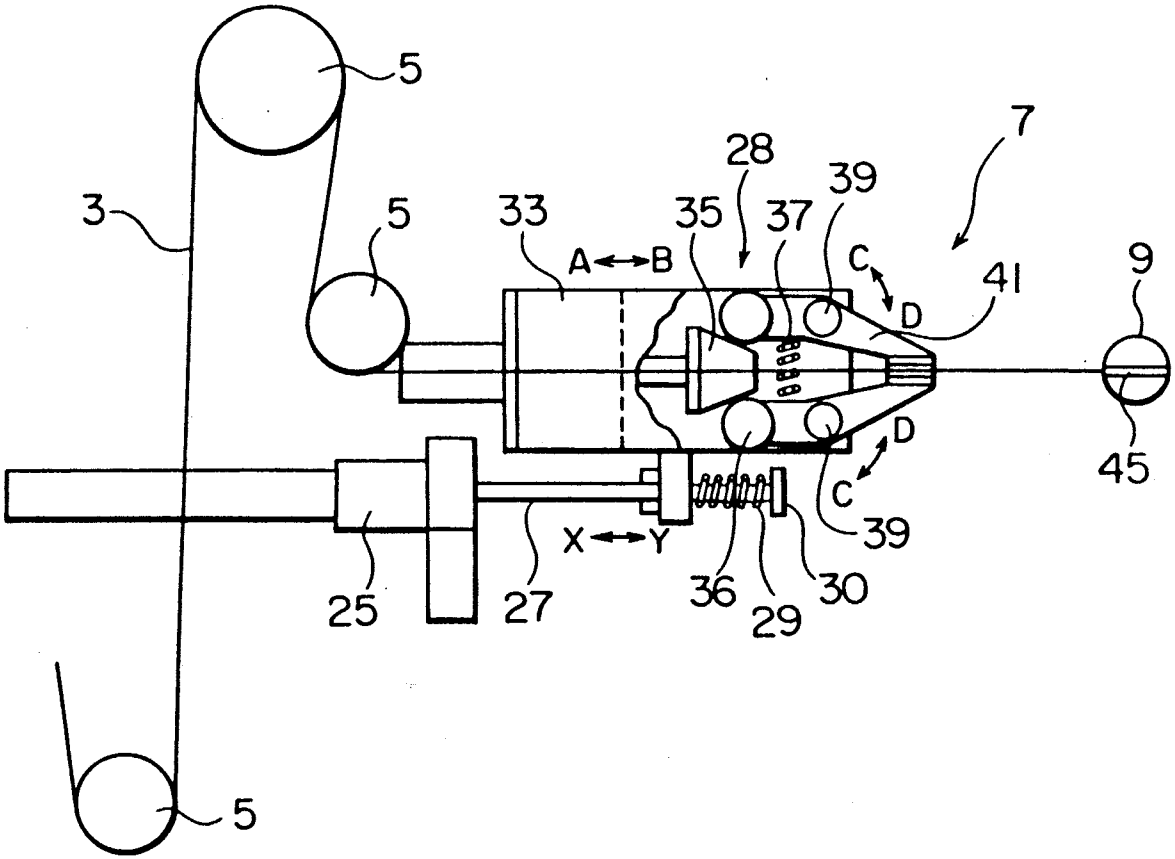
FIG. 2 is a diagram illustrating the construction of a clamping device.

FIG. 2 illustrates in detail the construction of this clamping device. An upper body 28 is fixed on a rod 27 adapted to slide inside a stationary feedout cylinder 25. This rod 27 is driven by the feedout cylinder 25 in the direction of XY. The rod 27 is provided at the leading end thereof with a supporting part 30. A spring 29 is interposed between this supporting part 30 and the mounting part of the upper body 28.

A clamp cylinder 33 is disposed behind the upper body 28. A pressing part 35 in the shape of a cone is driven by the clamp cylinder in the direction of A or B as shown in the diagram. In front of the upper body 28, a pair of clamp claws 41 are pivotally supported by a fulcrum 39. A receiving part 36 is disposed behind the clamp claws 41 and a spring 37 is interposed between the clamp claws 41.

When the pressing part 35 is moved by the clamp cylinder 33 in the direction of A as illustrated in the diagram, the spring 37 causes the clamp claws 41 to be moved in the direction of C as illustrated in the diagram and the clamp claws 41 to be diverged.

Conversely when the pressing part 35 is moved by the clamp cylinder 33 in the direction of B as illustrated in the diagram, since the receiving part 36 is pressed by the pressing part 35, the clamp claws 41 are moved in the direction of D as illustrated in the diagram and the clamp claws 41 are converged.

The ribbon-like thin strip 3 is clamped by first diverging and then converging the clamp claws 41. Thereafter, the feed cylinder 25 is actuated to move the rod 27 in the direction of Y and insert the leading end of the ribbon-like thin strip 3 into the thin hole in the winding core 9.

The clamp claws 41 are diverged after the ribbon-like thin strip 3 has been inserted in the winding core 9.

Figure 3:
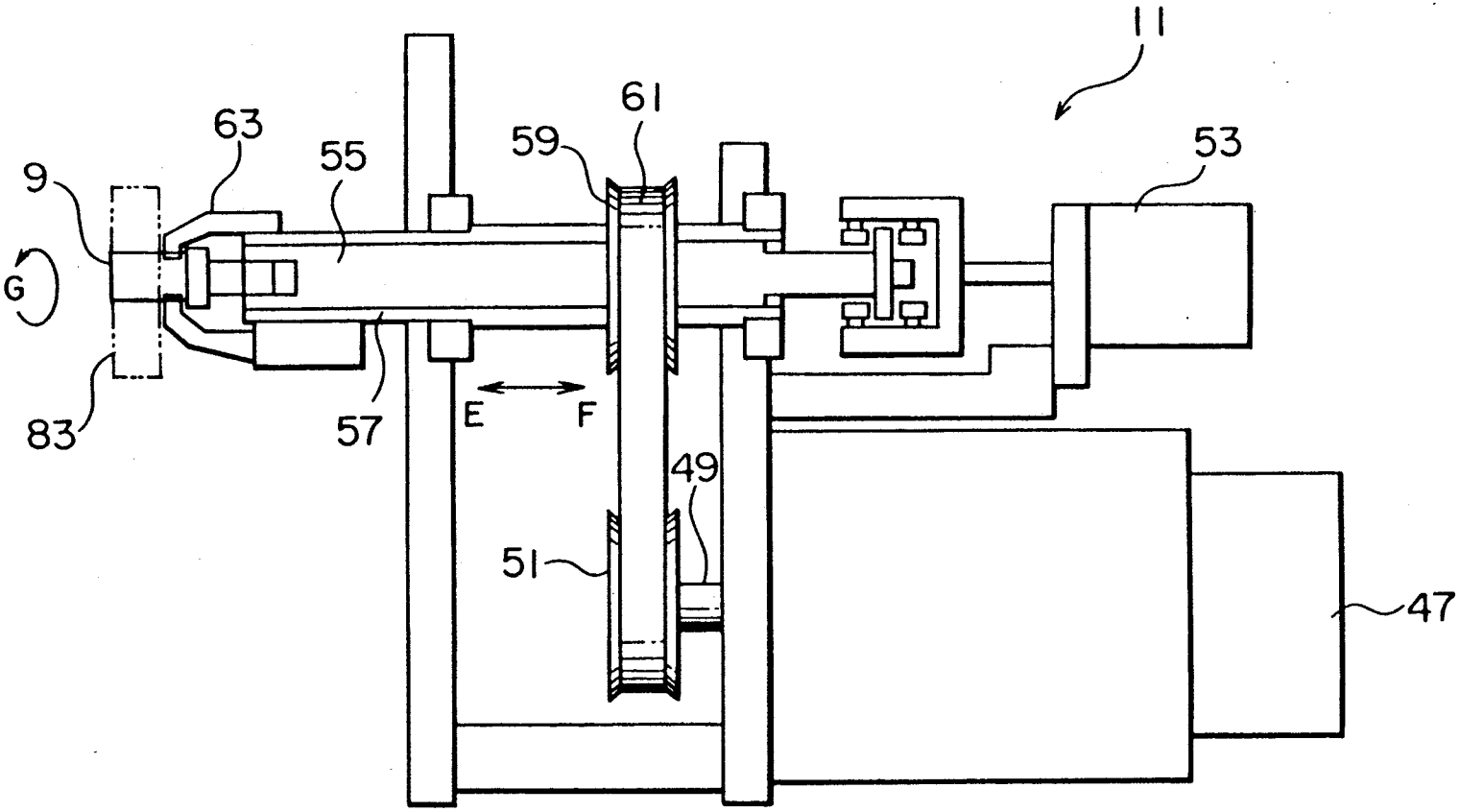
FIG. 3 is a diagram illustrating the construction of a winding core driving device.

FIG. 3 illustrates the construction of the winding core driving device.

This winding core driving device 11 serves the purpose of winding the ribbon-like thin strip 3 around the winding core 9 and gives rise to a core 83 of the ribbon-like thin strip 3.

As illustrated in FIG. 3, a first pulley 51 is attached to a rotary shaft 49 of a winding core rotating motor 47.

A winding core pulling cylinder 53 serves the purpose of moving a rod 55 in the direction of EF as illustrated in the diagram. This rod 55 is adapted to be slid inside a cover 57 and rotated sympathetically with the rotation of a second pulley in the direction of C as illustrated in the diagram. A timing belt 61 is wound round the second pulley 59 and the first pulley 51.

The cover 57 is provided at the leading end thereof with a stopper 63 and the rod 55 is provided at the leading end thereof with the winding core 9.

When the ribbon-like thin strip 3 is inserted into the thin hole 45 of the winding core 9 as described above, the winding core rotating motor 47 is set rotating. This rotation is transmitted through the timing belt 61 to the rod 55 and the winding core 9. The rotation thus imparted to the winding core 9 causes the ribbon-like thin strip 3 to be wound round the winding core 9 and allowed eventually to form the core 83.

When the ribbon-like thin strip 3 of a prescribed length has been wound over itself round the winding core 9, it is cut off by the cutting device 13. Then, the trailing end of the ribbon-like thin strip 3 is welded by the welding device 15 which will be described specifically below.

When the rod 55 is subsequently moved by the winding core pulling cylinder 53 in the direction of F illustrated in the diagram, the winding core 9 is moved in the direction of F as illustrated in the diagram as the result. At this time, since the core 83 collides against the stopper 63, the winding core 9 alone is allowed to continue its motion in the direction of F and the core 83 is caused to fall off the winding core 9.

Figure 4:
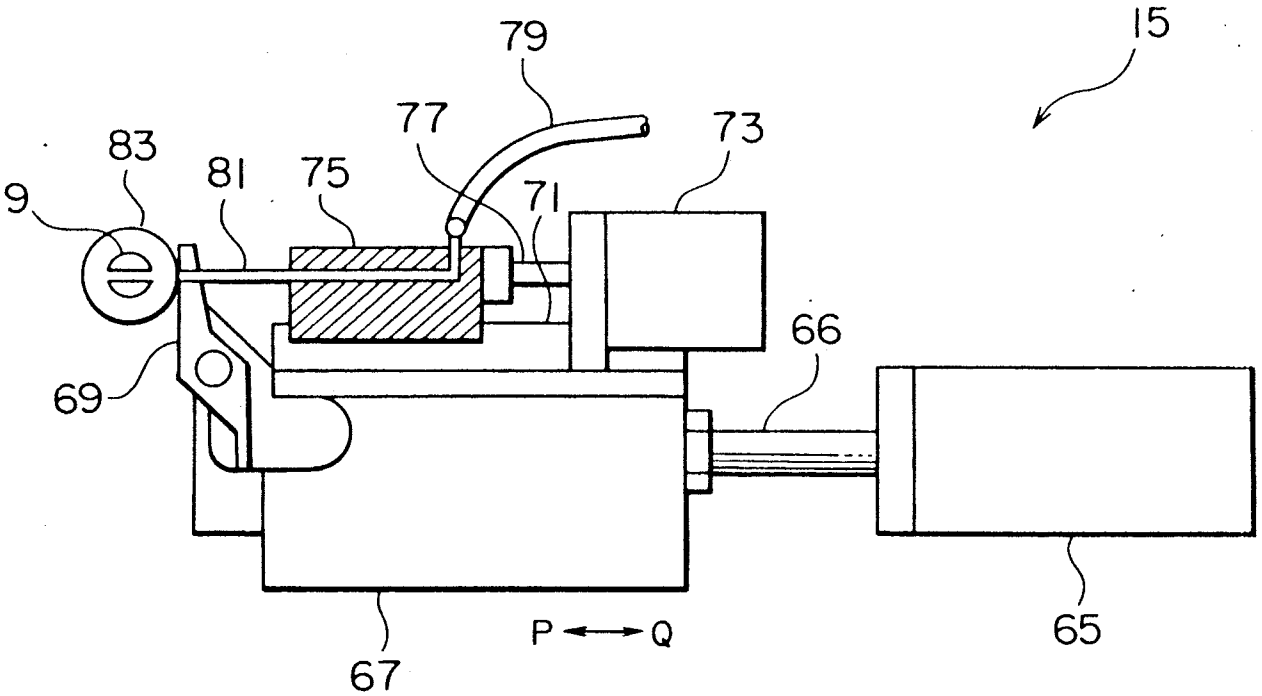
FIG. 4 is a diagram illustrating the construction of a welding device.

FIG. 4 is a diagram illustrating the construction of the welding device 15. To a welding device moving cylinder 65 which is stationarily installed, a base 67 is attached through the medium of a rod 66. The base 67 can be moved by the welding device moving cylinder 65 in the direction of PQ as illustrated in the diagram. A core guide 69 is attached to the front end of the base 67 and a rail 71 and a welding cylinder 73 are disposed fast on the upper surface of the base 67.

A slide unit 75 is slidably mounted on the rail 71. This slide unit 75 is moved in the direction of PQ as illustrated in the diagram by the welding cylinder 73 through the medium or a rod 77. This sliding unit 75 is provided with a welding electrode 81. The welding electrode 81 is connected to an electrode 79 and has the leading end thereof disposed on the core guide 69.

When the ribbon-like thin strip 3 is cut off by the cutting device 13 as described above, the core 83 is rotated slightly by the winding core driving device 11. Thereafter, the base 67 is moved in the direction of P as illustrated in the diagram and the leading end of the welding electrode 81 is brought into contact with the rear of the ribbon-like thin strip 3 of the core 83 to extend the flow of electric current and effect welding.

When the welding is completed, the core 83 which has been caused to fall off the winding core 9 by the winding core driving device 11 is transferred by the releasing device 17 to the measuring device 19.

The releasing device 19 comprises a cylinder 85 disposed so as to be rotated around a shaft 91 in the direction of H and I as illustrated in the diagram and a rod 87 adapted to slide inside the cylinder 85. Then rod 87 is provided at the leading end thereof with a magnet 89.

The cylinder 85, with the rod 87 kept in an extended state (indicated by a dotted line), is rotated in the direction of H and moved to a position such that the magnet 89 disposed at the leading end of the rod 87 will arrive directly below the core 83. The core 83 in this state is pulled down. The core 83, during the fall, is magnetically caught by the magnet 89. In the state consequently assumed, the cylinder 85 is rotated in the direction of I as illustrated in the diagram, with the result that the core 83 is transported onto the measuring device 19. By interrupting the magnetic force of the magnet 89 at this stage, the core 83 is set in place on the measuring device 19.

The measuring device 19 serves the purpose of weighing the core 83 and communicating the weight to the computer 23.

The computer 23, based on the weight of the core 83 so informed by the measuring device 19, determines the winding length of the next core to be formed and forwards the information to the controller 21.

The controller 21 is intended to drive the material spool 1, the guide rollers 5, the clamping device 7, the winding core driving device 11, the cutting device 13, and welding device 15, and the releasing device 17.

Figure 5:
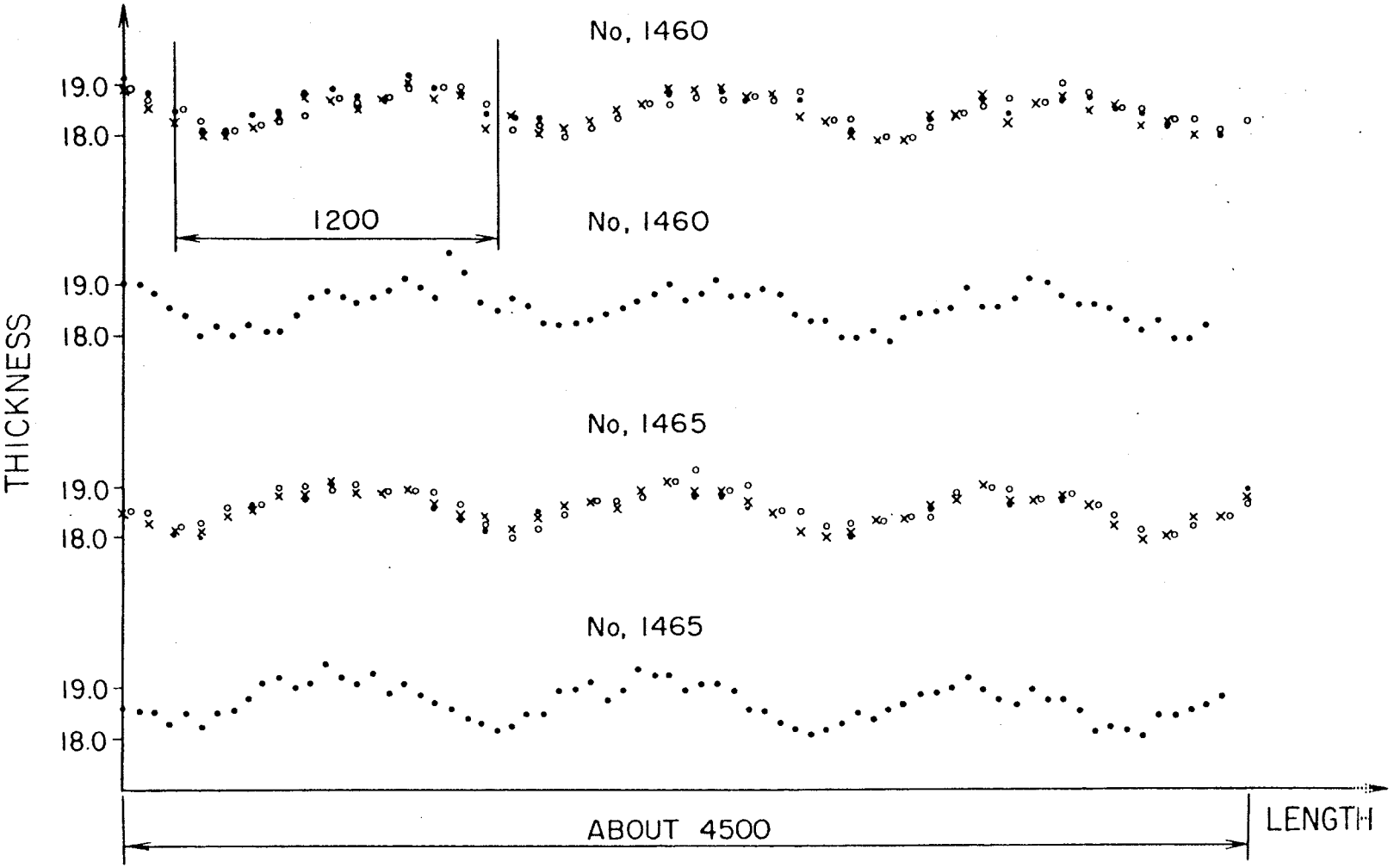
FIG. 5 is a diagram showing the relation between length and thickness of a ribbon-like thin strip.

FIG. 5 is a diagram showing the relation between the thickness and length of the ribbon-like thin strip 3 produced by the method of the present invention. In the diagram, the vertical axis is the scale of thickness and the horizontal axis the scale of length. It is clearly noted from this diagram that the ribbon-like thin strip 3 has the thickness thereof cyclically varied along the direction of length. When a plurality of rolls (or cores 83) of the ribbon-like thin strip 3 are cut in a fixed length by the cutting device 13, therefore, the thickness of the ribbon-like thin strips 3 is dispersed among these rolls. In the present working example, the impartation of a fixed weight to the plurality of rolls is accomplished by weighing each of the rolls produced immediately after the roll has been wound up and cut off, finding the cyclicity of thickness from the weight and estimating the winding length of the next roll on the basis of the cyclicity, and cutting the next roll in the estimated winding length.

It is possible to estimate the winding length of the next roll because the thickness of the next roll is 0.95 to 1.05 times of the previous roll as shown in FIG. 5.

Now, the processing for the calculation of the winding length of each roll by the use of the computer 23 will be described.

Figure 6:
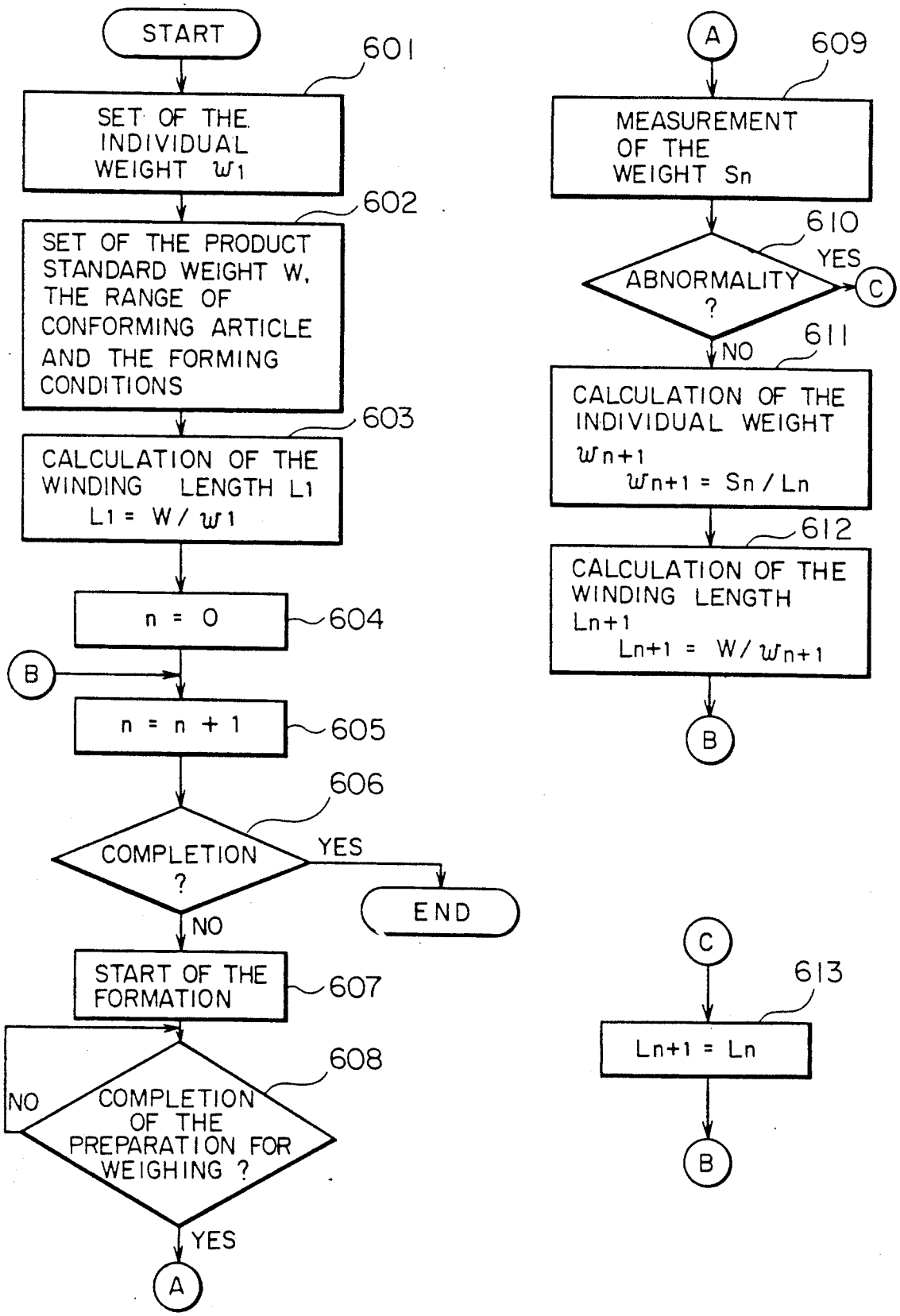
FIGS. 6 to 8 and FIG. 10 are flow charts illustrating the processes for the calculation of winding length in the relevant working examples.

FIG. 6 is a flow chart illustrating the processing for setting the winding length by the operation of the computer 23.

The computer 23 first sets the individual weight, $w_1$ of the thin strip (the individual weight means the weight per length of the thin strip) (Step 601) and then sets the standard weight, W, of the product, the range of conforming article, and the forming conditions (Step 602). The standard weight, W, of the product is the weight which the cut roll of the thin strip is expected to have as the standard. The term "range of conforming article" means the range in which the cut roll of the thin strip is judged as a conforming articles, with the weight $S_n$ as the criterion. To be specific, when the weight of a given then article has any of the following values, this thin strip is regarded as rejectable and subjected to the following abnormal processing.

$$S_n \approx 0,$$

$$S_n < S_{n-1} \times 0.88, \text{ or}$$

$$S_n > S_{n-1} \times 1.12$$

The term "forming conditions" refers to various conditions such as counterclockwise rotation and rotational speed of winding.

Then, the computer 23 calculates the winding length, $L_1$, of the first roll of thin strip in accordance with the following formula (Step 603).

$$L_1 = W/w_1$$

wherein W stands for the standard weight of product and $w_1$ for the individual weight.

Now, the computer sets the parameter, n, indicative of the number of thin strips to 0 (Step 604) and further add 1 to the n (Step 605).

It then decides as to whether or not the winding is completed (Step 606) and terminates the processing when the decision is in the affirmative of starts the formation when the decision is in the negative (Step 607). To be specific, for the purpose of driving the apparatus for the production of the thin strip illustrated in FIG. 1, the computer 23 issues an instruction to the controller 21 to wind the thin strip in the winding length, $L_1$, and to cut off the roll consequently formed.

When the preparation for weighing is completed (Step 608), the weight, $S_n$, of the thick article is taken (Step 609) and the roll is judged as free from abnormality (Step 610) when the weight so taken falls in the range of conforming article mentioned above. The individual weight, $w_{n+1}$, for the calculation of the winding length, $L_{n+1}$, of the next thin strip is calculated (Step 611) in accordance with the formula:

$$w_{n+1} = S_n/L_n$$

The winding length, $L_{n+1}$, is calculated (Step 612) in accordance with the following formula.

$$L_{n+1} = W/w_{n+1}$$

The processing is returned to Step 605 to repeat the normal operation.

When the weight, $S_n$, taken in the Step 610 fails to fall inside the range or conforming article and the roll is judged to be abnormal, the processing with respect to the winding length, $L_{n+1}$, of the next thin strip is carried out (Step 613) by assuming the following equation.

$$L_{n+1} = L_n$$

In accordance with the present working example, the variation of weight among the cut sections of thin strip due to the variation of thickness of the thin strip is alleviated because the individual weight of the section of the thin strip to be cut on the next round is estimated based on the weight of the section of the thin strip freshly cut off and the winding length of the section of the thin strip to be cut off on the next round.

Figure 7A:
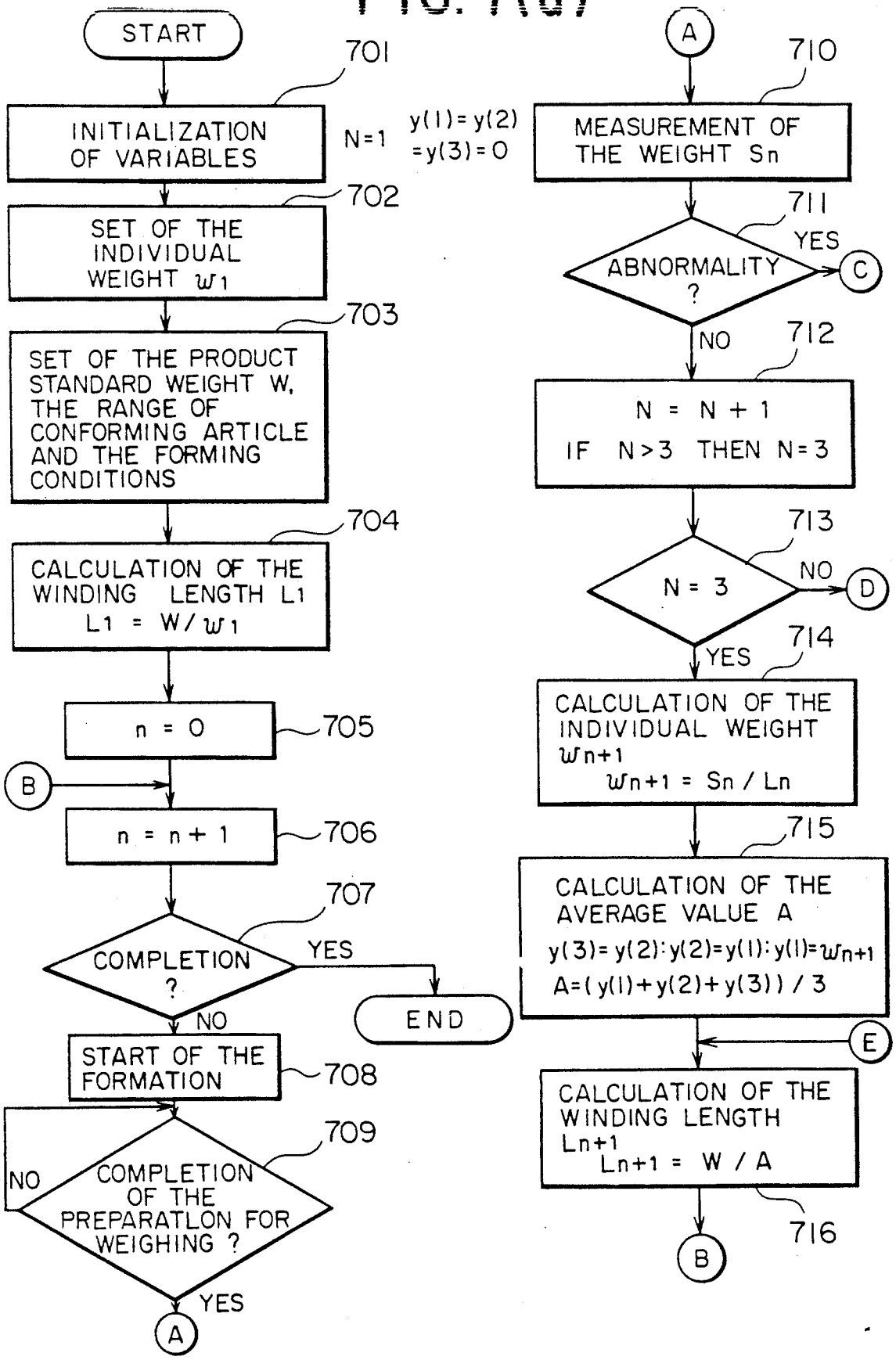
Figure 7B:
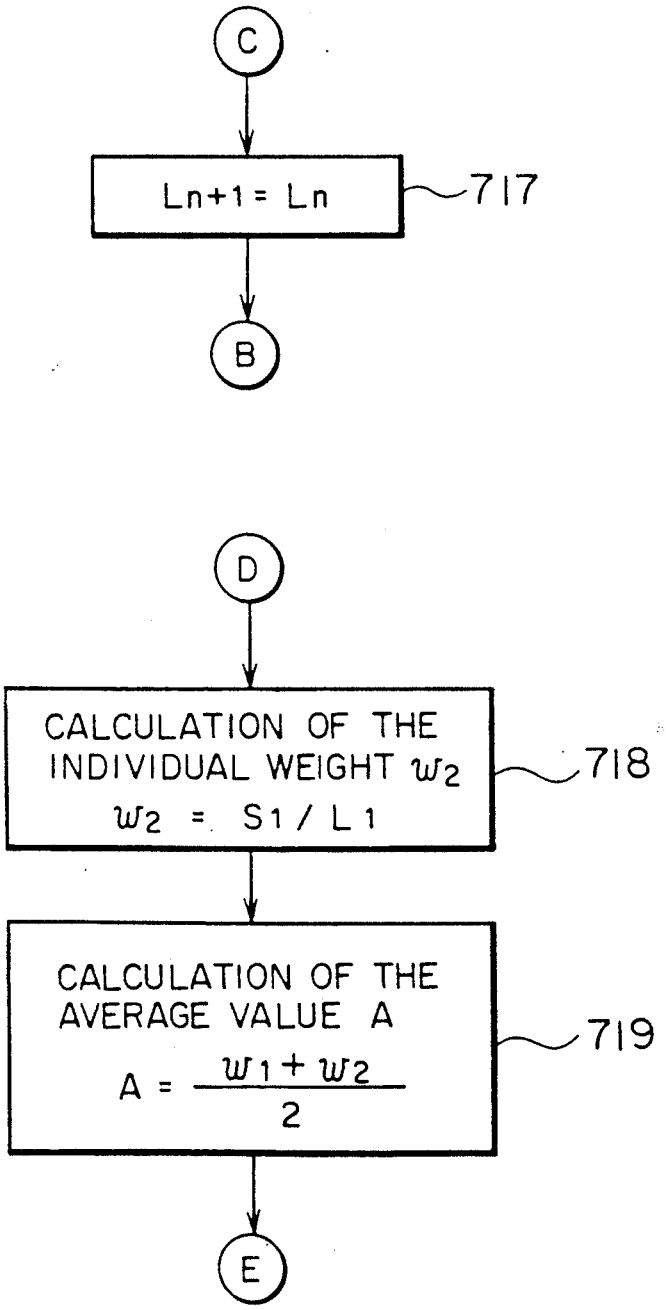

FIG. 7 is a flow chart illustrating another method for the calculation of the winding length of the thin strip. By this method, the individual weights of the sections of the thin strip so far produced are averaged and the winding length of the section of the thin strip to be cut off on the next round is decided based on the average.

Now, the part of the processing illustrated in FIG. 7 which differs from the processing illustrated in FIG. 6 will be described below.

First, the computer 23 carries out initialization of variables (Step 701). The term "variables" as used herein refers to the parameter, N, indicative of the modulus for the calculation of the average and y(1), y(2), and y(3) on the assumption of the following relations.

$$N = 1$$

$$y(1) = y(2) = y(3) = 0$$

Then, the computer carries out the same processing as illustrated in FIG. 6. When the absence of abnormality is confirmed in the Step 711, N is increased by 1 and N is set at '3', when the N resulting from the increase is larger than '3' (Step 712).

When N is not equal to '3', the individual weight, $w_2$, is calculated (Step 718) in accordance with the following formula.

$$w_2 = S_1/L_1$$

And the average value, A, is calculated (Step 719) in accordance with the following formula.

$$A = (w_1 + w_2)/2$$

When N is found to be equal to '3' in the Step 713, the individual weight, $w_{n-1}$, is calculated (Step 714) in accordance with the following formula.

$$w_{n+1} = S_n/L_n$$

And the average value, A, is calculated (Step 715) in accordance with the following formulas.

$$y(3)=y(2),\ y(2)=y(1)$$

$$y(1)=w_{n+1}$$

$$A=[y(1)+y(2)+y(3)]/3$$

And the winding length, $L_{n+1}$, is calculated (Step 716) in accordance with the following formula.

$$L_{n+1}=W/A$$

Then the processing is returned to Step 706.

The present working example has been depicted as deciding the winding length of the thin strip to be produced in the next round on the basis of the average of the individual weights of three sections of the thin strip produced so far. The number of the produced sections of the thin strip to be used for the averaging is not limited to 3 but may be changed to 4, 5, or any other integer.

Figure 8A:
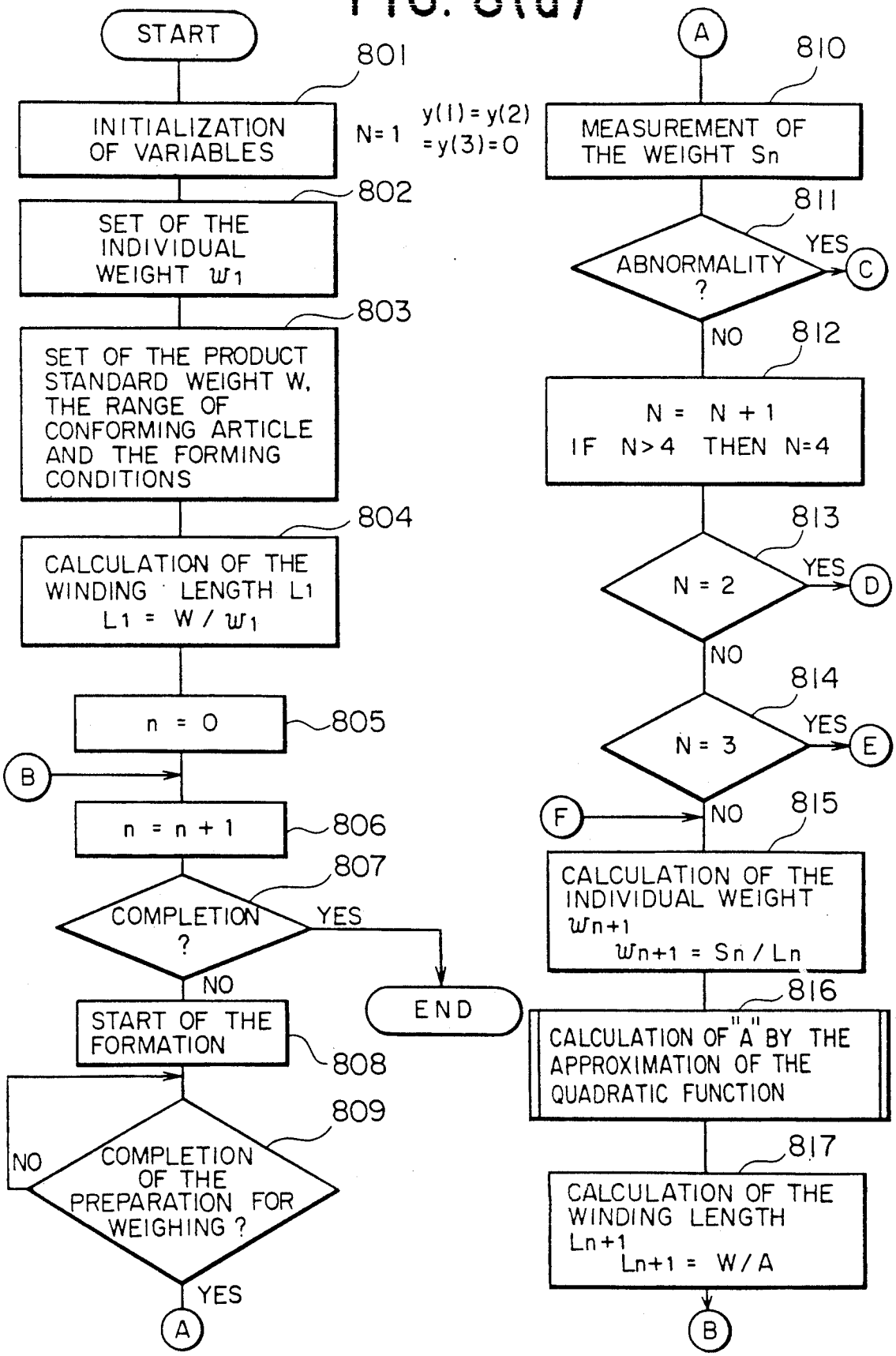
Figure 8B:
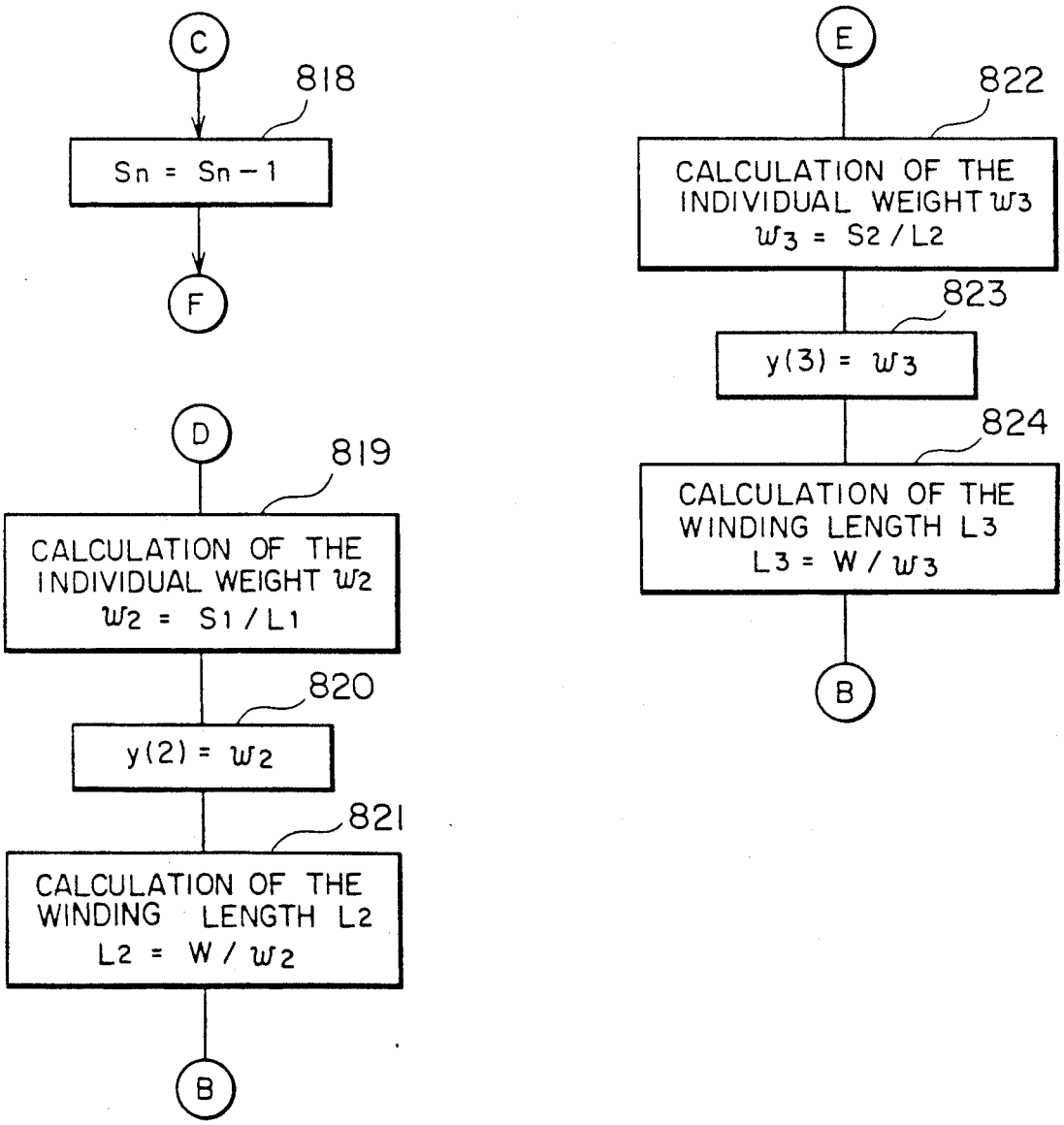
Figure 8C:
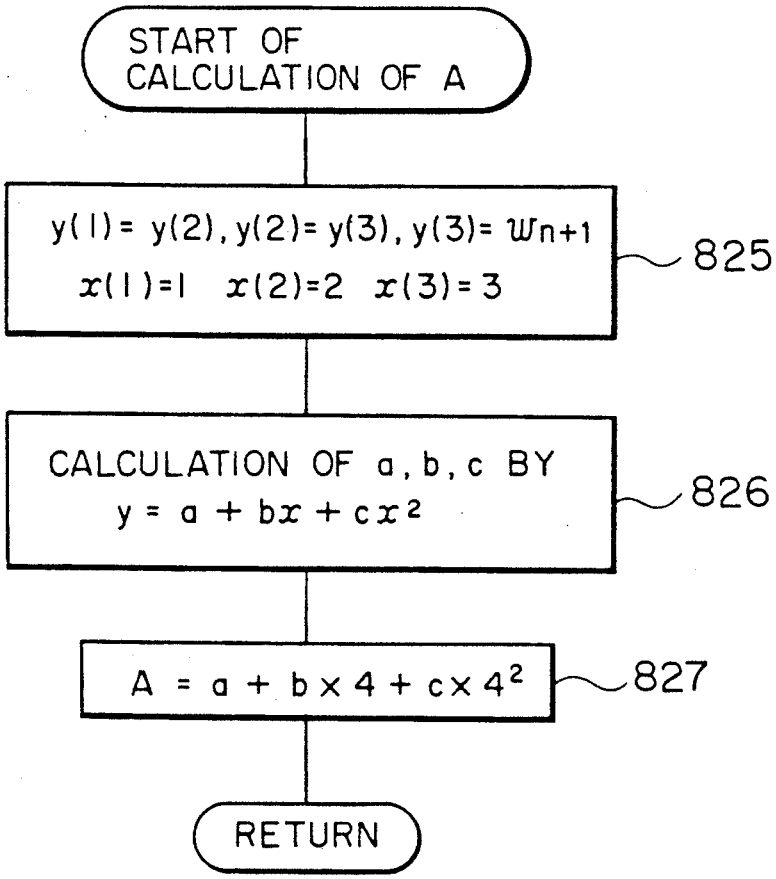

FIG. 8 is a flow chart illustrating still another method for the calculation of the winding length of the thin strip. This method comprises approximating a quadratic curve from the individual weights of the last three sections of the thin strips produced, calculating a parameter A in accordance with the approximated curve, and then calculating the winding length of the section of the thin strip to be produced in the next round on the basis of the parameter A.

In the Step 801, the initialization of variables is carried out. In consequence of this initialization, the following relations are established.

$$N=1$$

$$y(1)=y(2)=y(3)=0$$

In the Step 812, N is increased by 1 and the N is set at '4', when the increased N is larger than '4'. When the N is equal to '2' (Step 813), the individual weight $w_2$, is calculated (Step 819) in accordance with the following formula.

$$w_2=S_1/L_1$$

Then, on the basis of the following relation (Step 820).

$$y(2)=w_2$$

the winding length, $L_2$, is calculated (Step 821) by the following formula.

$$L_2=W/w_2$$

When the N is equal to '3' (Step 814), the individual weight, $w_3$, is calculated (Step 822) in accordance with the following formula.

$$w_3=S_2/L_2$$

Then, on the basis of the following relation (Step 823), $$y(3)=w_3$$

the winding length, $L_3$, is calculated (Step 824) in accordance with the following formula.

$$L_3=W/w_3$$

When the N is equal to '4', the individual weight, $w_{n+1}$, is calculated (Step 815) in accordance with the following formula.

$$w_{n+1}=S_n/L_n$$

Then, the parameter A is calculated (Step 816) by the approximation of the quadratic function.

Figure 9:
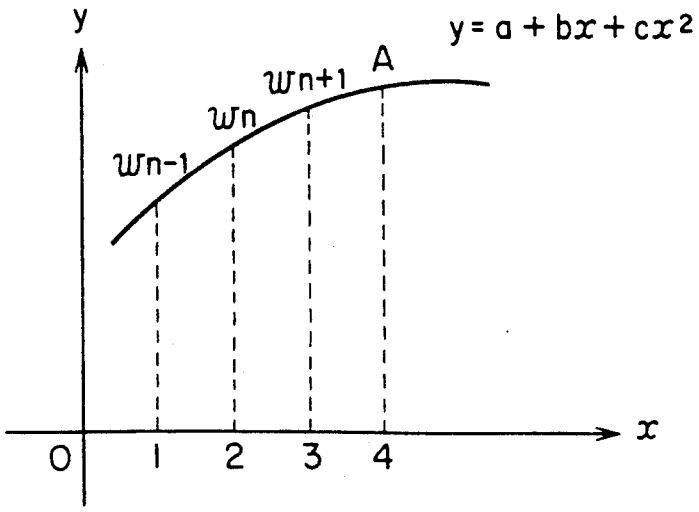
FIG. 9 is a diagram for the explanation of the approximation by the quadratic functions.
Figure 10A:
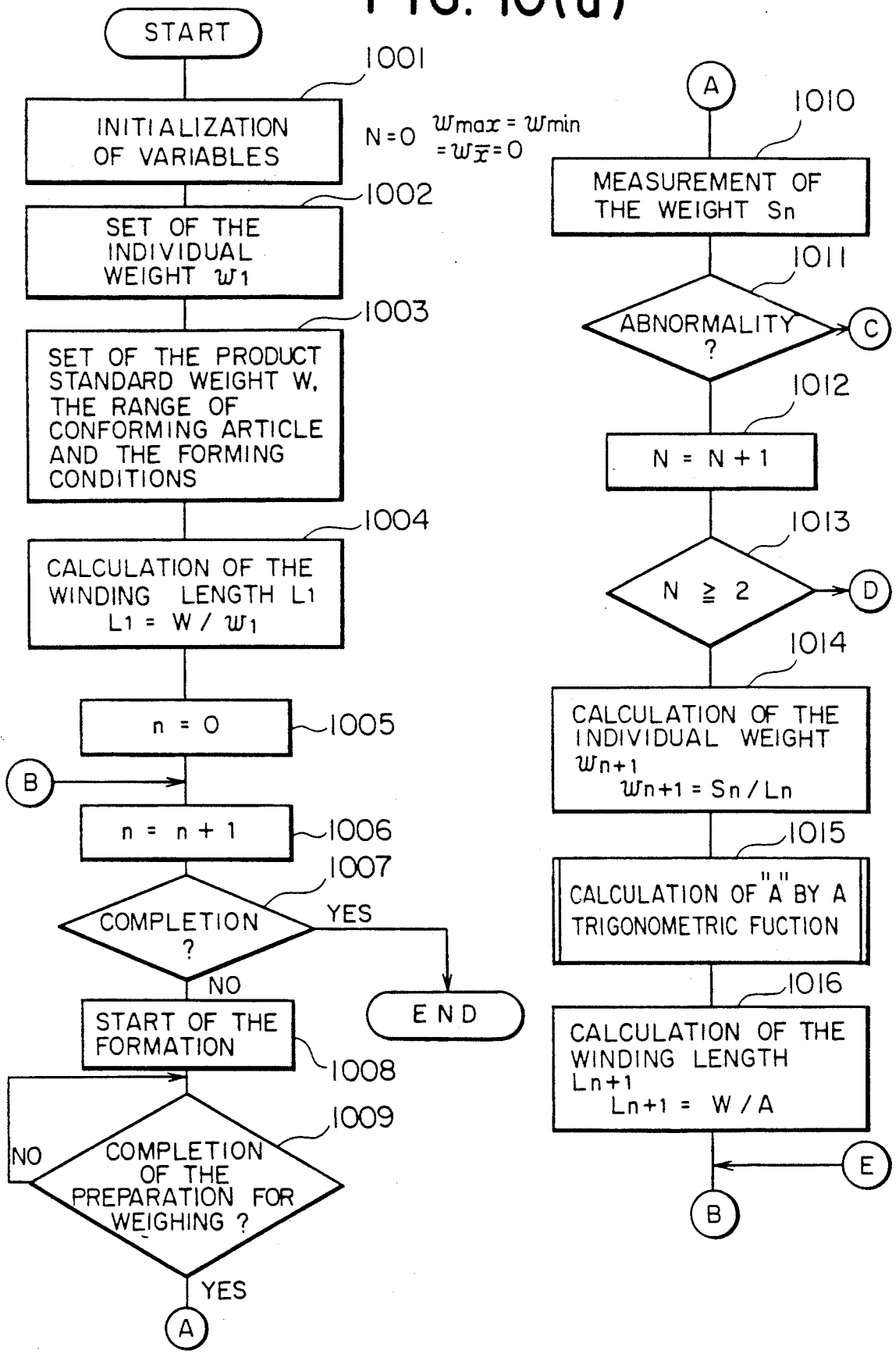
Figure 10B:
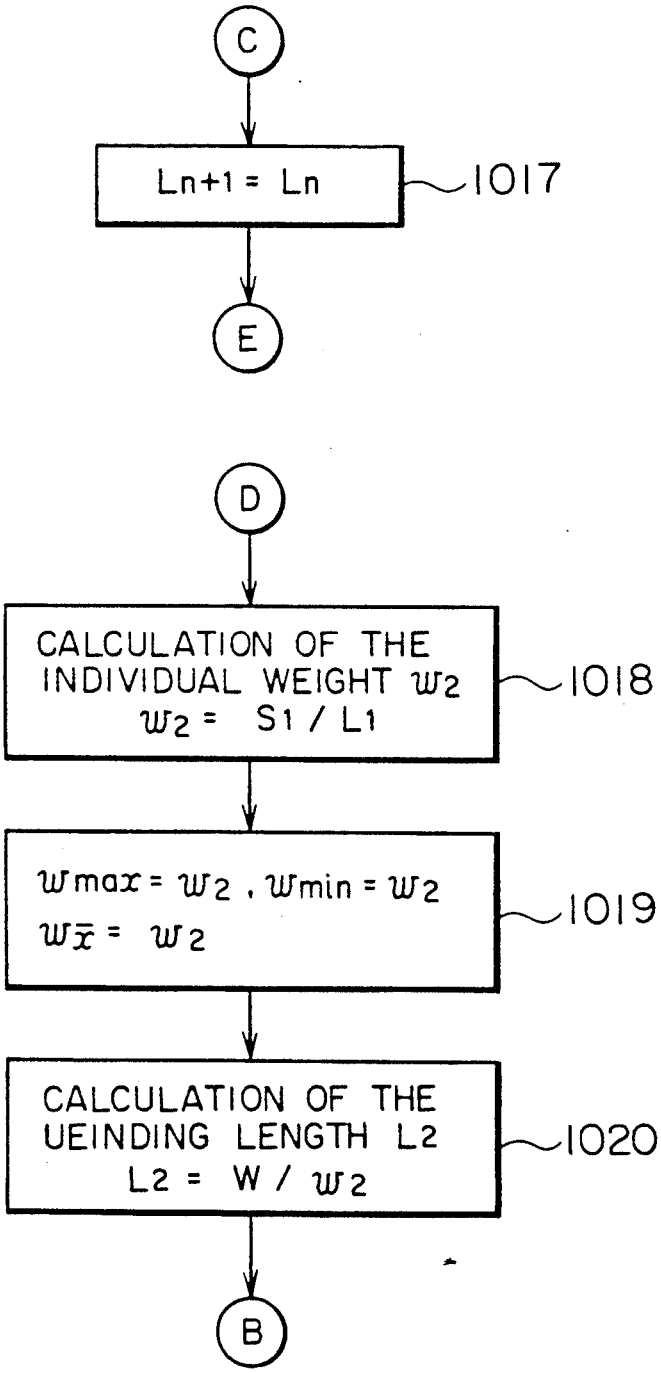
Figure 10C:
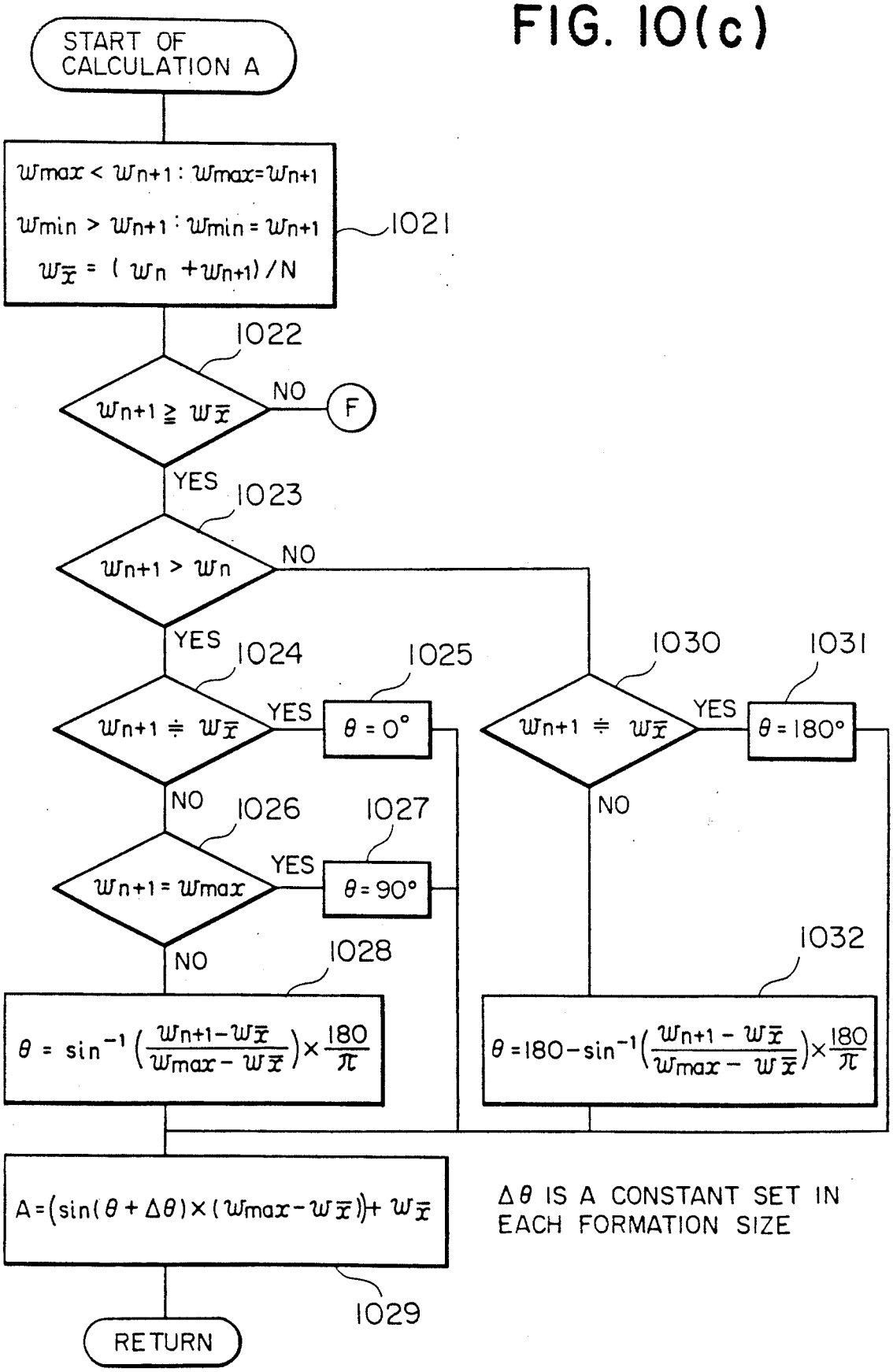
Figure 10D:
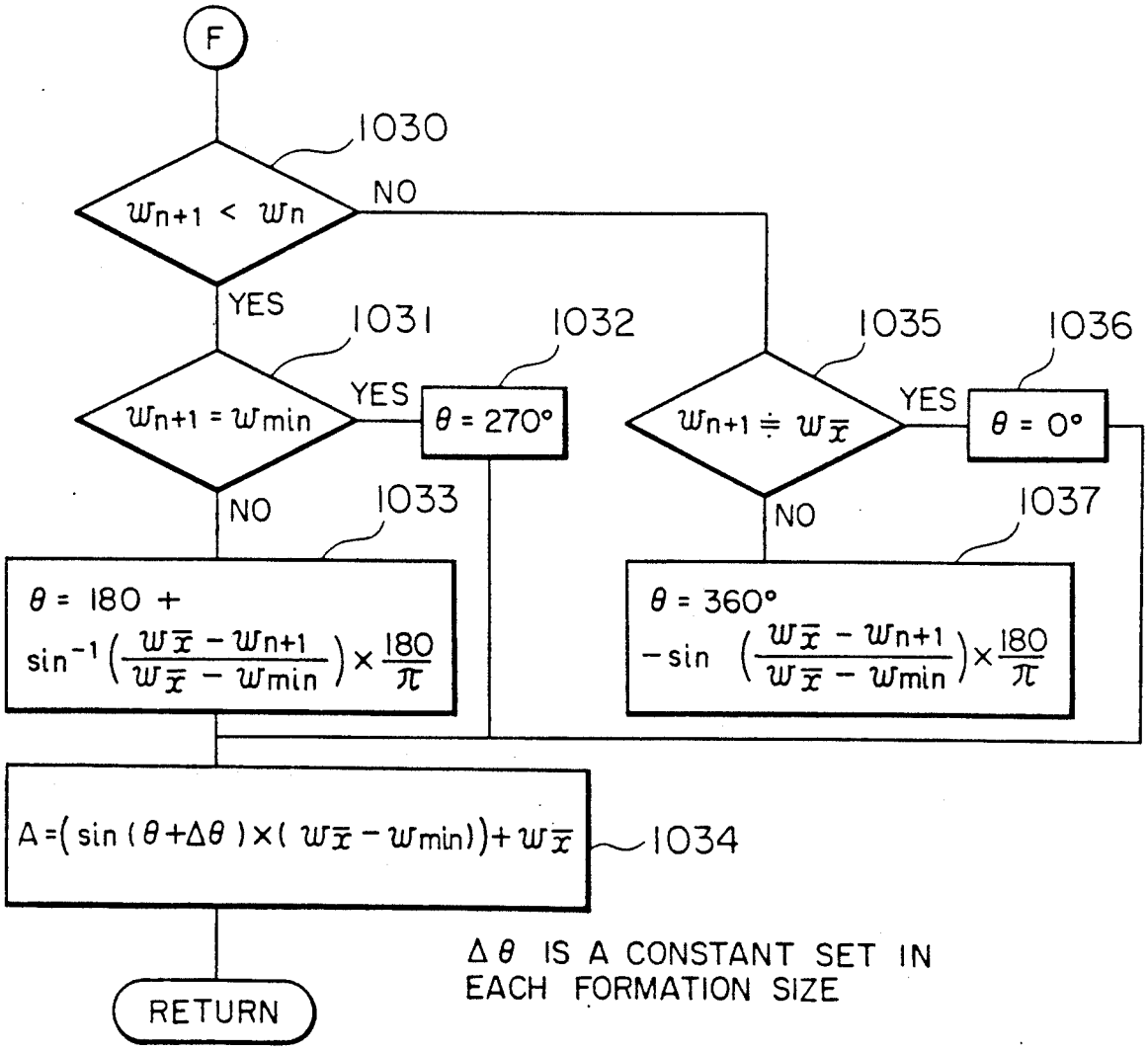

The processing for the approximation of the quadratic function is illustrated in FIG. 8(*c*). This processing for the approximation of the quadratic function, as illustrated in FIG. 9, comprises assuming the relation, $$y=w_n=a+bx+cx^2$$

sequentially adding 1 to x, and calculating A from $w_{n-1}$, $w_n$, $w_{n+n}$.

Specifically, at the Step 825, a, b, and c are calculated (Step 826) in accordance with the following formula.

$$y=a+bx+cx^2$$

on the basis of the following relations.

$$y(1)=y(2),\ y(2)=y(3)$$

$$y(3)=w_{n-1}$$

$$x(1)=1,\ x(2)=2,\ x(3)=3$$

And the parameter, A, is calculated (Step 827) in accordance with the following formula.

$$A=a+4b+4^2c$$

FIG. 10 is a flow chart illustrating yet another method for the calculation of the winding length.

At the Step 1001, the initialization of variables is so effected as to establish the following relations.

$$N=0$$

$$w_{max}=w_{min}=w_{\bar{x}}=0$$

wherein $w_{\bar{x}}$ stands for the average value.

At the Step 1012, N is increased by 1 and individual weight, $w_2$, is calculated (Step 1018) when the increased N is equal to '1' in accordance with the following formula.

$$w_2=S_1/L_1$$

And, on the basis of the following relations (Step 1019), $$w_{max}=w_2,\ w_{min}=w_2$$

$$w_{\bar{x}}=w_2$$

the winding length, $L_2$, is calculated (Step 1022) in accordance with the following formula.

$$L_2=W/w_2$$

At the Step 1013, when the N is more than '2,' the individual weight, $w_{n+1}$, is calculated (Step 1014) in accordance with the following formula.

$$w_{n+1}=S_n/L_n$$

And the parameter, A, is calculated by the approximation of a trigonometric function (Step 1015).

To be specific, on the assumption (Step 1021) of the following relations, $$w_{max}=w_{n+1}, \text{ if } w_{max}<w_{n+1}$$

$$w_{min}=w_{n+1}, \text{ if } w_{min}>w_{n+1}$$

$$\bar{w}_x=(w_n+w_{n+1})/N$$

when the following relation is confirmed (Step 1022), $$w_{n+1}\geqq\bar{w}_x$$

the following relation is confirmed (Step 1023), $$w_{n+1}>w_n$$

and the following relation is confirmed (Step 1024), $$w_{n+1}\approx\bar{w}_x$$

the following condition is established (Step 1025).

$$\theta=0°$$

At the Step 1024, when the following relation is denied, $$w_{n+1}\approx\bar{w}_x$$

and the following relation is confirmed (Step 1026), $$w_{n+1}=w_{max}$$

the following condition is established (Step 1027).

$$\theta=90°$$

At the Step 1026, the value of $\theta$ is found in accordance with the formula of the Step 1028 and the value of A in accordance with the formula of the Step 1029 is found.

At the Step 1023, the following condition is established (Step 1030), $$\theta=180°$$

when the following relation is denied (Step 1023), $$w_{n+1}\geqq w_n$$

and the following relation is confirmed (Step 1030).

$$w_{n+1}\approx\bar{w}_x$$

The value of $\theta$ is found in accordance with the formula of the Step 1032 where the following relation is denied.

$$w_{n+1}\approx\bar{w}_x$$

Then, the value of A is calculated in accordance with the formula of the Step 1029, using the value of the $\theta$ to be found as described above.

At the Step 1022, when the following relation is denied, $$w_{n+1}\geqq\bar{w}_x$$

the following relation is confirmed (Step 1030), $$w_{n+1}<w_n$$

and the following relation is confirmed (Step 1031), $$w_{n+1}=w_{min}$$

the following condition is established (Step 1032).

$$\theta=270°$$

The value of $\theta$ is found in accordance with the formula of the Step 1033 when the following relation is denied.

$$w_{n+1}=w_{min}$$

Then, the value of A is found in accordance with the formula of the Step 1034, using the value of $\theta$ to be found as described above.

At the Step 1030, when the following relation is defined, $$w_{n+1}<w_n$$

and the following relation is confirmed (Step 1035), $$w_{n+1}\approx\bar{w}_x$$

the following condition is established (Step 1036).

$$\theta=0°$$

The value of $\theta$ is found in accordance with the formula of the Step 1037 when the following relation is denied.

$$w_{n+1}\approx\bar{w}_x$$

The value of A is found in accordance with the formula of the Step 1034, using the value of $\theta$ to be found as described above.

As described in detail above, the present working example permits alleviation of the variation of weight due to the variation of thickness of the ribbon-like thin strip and ensures impartation of a fixed weight to the cut sections of the thin strip by using the individual weights of the rolls of thin strip so far produced in finding the winding length, $L_{n+1}$, of the roll of thin strips to be produced in the next round.

In the following four methods, (1) The method which sets the winding length of the thin strip to be produced in the next round by using the individual weight of the thin strip produced in the immediately preceding round without any modification, (2) The method which sets the winding length of the thin strip to be produced in the next round by using the average of the weights of the sections of thin strip produced up to the immediately preceding round, (3) The method which sets the winding length of the thin strips to be produced in the next round by using the parameter A which is obtained by approximating the individual weights of the seconds of thin strip produced up to the immediately preceding round by the quadratic functions, and (4) The method which sets the winding length of the thin strip to be produced in the next round by using the parameter A which is obtained by approximating the individual weights of the sections of thin strip produced up to the immediately preceding round by the trigonometric functions, the accuracy with which the winding length is set increases in the order of (1), (2), (3), and (4).

What is claimed is:

1. An apparatus for the production of a thin strip core, comprising:

a spool for winding a ribbon-like thin strip, clamping means for clamping and moving said ribbon-like thin strip, winding core driving means for causing said ribbon-like thin strip clamped by said clamping means to be wound in a prescribed length around a winding core, cutting means for cutting said ribbon-like thin strip after said ribbon-like thin strip has been wound in said prescribed length around said winding core, connecting means for connecting the trailing end of said wound thin strip cut off by the cutting means, releasing mean for releasing the connected wound thin strip, and means, cooperating with said releasing means, for determining the weight of wound thin strip released by the releasing means.

2. The apparatus according to claim 1, wherein said clamping means has an upper body capable of moving, said upper body comprising a clamp cylinder and clamp claws which face one another and which are diverged and converged by said clamp cylinder.

3. The apparatus according to claim 1, wherein said winding core driving means comprises:

a rod capable of rotating and sliding, said winding core being attached to an end of said rod;

a motor for rotating said rod, and a cylinder for sliding said rod.

4. The apparatus according to claim 1, wherein said connecting means comprises:

a base capable of moving;

a cylinder for moving said base;

a core guide attached to an end of said base;

a slide unit slidably mounted on said base, and a welding electrode provided with said slide unit.

5. The apparatus according to claim 1, wherein said releasing means comprises a cylinder capable of rotating in a vertical surface and a rod sliding inside said cylinder, said rod having a magnet at an end thereof.

6. A method for the production of thin strip cores, the method comprising the steps of:

winding an n'th section of a ribbon-like thin strip, having a prescribed length $L_n$, onto a winding core to form a thin strip core, cutting said ribbon-like thin strip, determining the weight, $S_n$, of the n'th section of thin strip cut by said cutting step, calculating the weight $w_{n+1}$, of said n'th section of thin strip per unit length by dividing the weight, $S_n$, taken as described above by the length, $L_n$, and calculating the length, $L_{n+1}$, of an (n+1)'th section of thin strip by using the standard weight of product, W, and said weight, $W_{n+1}$, per unit length.

7. The method according to claim 6, wherein said step of calculating the length, $L_{n+1}$, of said (n+1)th section of thin strip to be cut consists in the following arithmetic operation.

$$L_{n+1} = W/w_{n+1}$$

8. The method according to claim 6, wherein said step of calculating the length, $L_{n+1}$, of said (n+1)'th section of thin strip to be cut consists of the following arithmetic operation, $$L_{n+1} = W/A,$$

wherein "A" represents the average of weights per unit length of the sections of thin strip produced up to the n'th section of thin strip.

9. The method according to claim 8, wherein said average represents one of 3, 4, and 5 sections of thin strip.

10. The method according to claim 6, wherein said step of calculating the length, $L_{n+1}$, of the (n+1)'th section of thin strip to be cut comprises finding a, b, and c in the following quadratic functions, $$y(x) = a + bx + cx^2$$

on the assumption of the relations, $w_{n-1} = y(1)$, $w_n = y(2)$, and $w_{n+1} = y(3)$, $w_{n-1}$, $w_n$, $w_{n+1}$ standing respectively for the weights per unit length of the sections of thin strip, finding the parameter, A, in accordance with A = y(4), and carrying out the calculation of the following formula.

$$L_{n+1} = W/A$$

11. The method according to claim 6, wherein said step of calculating the length, $L_{n+1}$, of the (n+1)' section of thin strip to be cut comprises approximating the weight, $w_n$, per unit length of said thin strip by the trigonometric functions, finding the variable, A, and calculating the following formula.

$$L_{n+1} = W/A$$

12. The method according to claim 6, further comprising the steps of removing the thin strip core, composed of said n'th section of said thin strip, from said winding core before the step of determining the weight of said n'th section, and then winding another section of ribbon-like metal strip, having the calculated length $L_{n+1}$, onto said winding core after the step of calculating the length $L_{n+1}$ to form another thin strip core.

* * * * *